US008162290B1

(12) United States Patent
Tracy

(10) Patent No.: US 8,162,290 B1
(45) Date of Patent: Apr. 24, 2012

(54) HITCH MOUNTED JACK ADAPTER DEVICE

(76) Inventor: Clint E. Tracy, Leavenworth, KS (US)

( * ) Notice: Subject to any disclaimer, the term of this patent is extended or adjusted under 35 U.S.C. 154(b) by 0 days.

(21) Appl. No.: 13/041,940

(22) Filed: Mar. 7, 2011

(51) Int. Cl.
*B66F 3/00* (2006.01)

(52) U.S. Cl. ..... 254/133 R; 280/475; 280/491.5

(58) Field of Classification Search ..... 280/491.5, 280/475, 763.1, 762, 769; 254/133 R, 1, 254/DIG. 4, 100, 95, 98, 420, 419, 418, 507
See application file for complete search history.

(56) References Cited

U.S. PATENT DOCUMENTS

| | | | | | |
|---|---|---|---|---|---|
| 2,153,722 | A * | 4/1939 | Loughmiller | ..... | 254/420 |
| 2,539,897 | A * | 1/1951 | Davey et al. | ..... | 254/98 |
| 2,844,390 | A * | 7/1958 | Smith | ..... | 280/477 |
| 3,614,064 | A * | 10/1971 | Bennett | ..... | 254/418 |
| D248,460 | S | 7/1978 | Dunn et al. | | |
| 5,020,777 | A | 6/1991 | Yocum | | |
| 6,003,892 | A * | 12/1999 | Henson | ..... | 280/504 |
| 6,361,023 | B1 * | 3/2002 | Peavler | ..... | 254/424 |
| 7,192,007 | B2 | 3/2007 | Thomas | | |
| 7,370,844 | B2 * | 5/2008 | McGriff | ..... | 254/420 |
| 7,611,160 | B1 * | 11/2009 | Ignacio | ..... | 280/475 |
| 7,722,011 | B1 | 5/2010 | Edwards | | |
| 2006/0237700 | A1 * | 10/2006 | Thomas | ..... | 254/133 R |
| 2010/0187489 | A1 * | 7/2010 | Hebert | ..... | 254/420 |
| 2011/0253954 | A1 * | 10/2011 | Fortner | ..... | 254/98 |

* cited by examiner

*Primary Examiner* — Tashiana Adams

(57) ABSTRACT

The hitch mounted jack adapter device provides for removable insertion into an existing receiver hitch. The device receives the jack I-beam of an existing hi-lift jack. The smooth use of the device is provided by the spaced apart first rollers and second rollers that guide the existing jack I-beam through the I-shaped jack notch of the device. The vertically spaced apart first rollers and second rollers further provide defined vertical guidance of the jack I-beam. By negating binding and significantly reducing friction, combined with the gusset disposed between the hitch insert and the riser of the jack receiver, the device further provides for safe operation through strength coupled with frictional reduction. Of importance is that the device provides for easy, uncomplicated use.

2 Claims, 4 Drawing Sheets

HITCH MOUNTED JACK ADAPTER DEVICE

BACKGROUND OF THE INVENTION

A variety of vehicle lifting means have been used throughout the modern and not-so-modern ages. As pertains to motor vehicles, we see bumper jacks, frame jacks, hoists, and other means, as example. There is evidenced a need for using the receiver hitch of an automobile for lifting that automobile. In that vein, using a receiver hitch in collusion with an existing hi-lift jack can be of great advantage. The present device provides unique advantages in a removable hitch mounted jack adapter, including strength, ease of use, roller contact with the existing jack I-beam, and serviceability.

FIELD OF THE INVENTION

The hitch mounted jack adapter device relates to vehicle lifting means and more especially to a removable hitch mounted jack adapter that inserts into a receiver hitch and allows the used of an existing hi-lift jack.

SUMMARY OF THE INVENTION

The general purpose of the hitch mounted jack adapter device, described subsequently in greater detail, is to provide a hitch mounted jack adapter device which has many novel features that result in an improved hitch mounted jack adapter device which is not anticipated, rendered obvious, suggested, or even implied by prior art, either alone or in combination thereof.

To attain this, the hitch mounted jack adapter device provides for removable insertion into an existing receiver hitch, typically of an automobile of virtually any sort. The device then provides for the slideable insertion of the jack I-beam of an existing hi-lift jack, as they are commonly known. A great advantage of the device is that it provides for smooth jack I-beam travel within the device. This smooth travel is provided by the spaced apart first rollers and second rollers that guide the existing jack I-beam through the I-shaped jack notch of the device. The vertically spaced apart first rollers and second rollers further provide defined vertical guidance of the jack I-beam. By negating binding and significantly reducing friction, combined with the gusset disposed between the hitch insert and the riser of the jack receiver, the device further provides for safe operation through strength coupled with frictional reduction. Of importance is that the device provides for easy, uncomplicated use. A user need only insert the hitch insert into an existing receiver hitch, following with the insertion of a hitch pin through the hitch insert and the receiver hitch. The device is typically first coupled with an existing hi-lift jack I-beam inserted through the rollers and the I-shaped jack notch. The jack notch may comprise other shapes. The economy of parts and carefully engineered design provide for both easy use and low cost of production and sale.

While various fasteners may be used to locate the rollers, both first rollers and second rollers, the bolts with nuts are preferred, as these provide the quickest means for roller and bolt change out, should rollers and bolts see wear from extended use.

Thus has been broadly outlined the more important features of the improved hitch mounted jack adapter device so that the detailed description thereof that follows may be better understood and in order that the present contribution to the art may be better appreciated.

An object of the hitch mounted jack adapter device is to be removably received by an automobile receiver hitch.

Another object of the hitch mounted jack adapter device is to removably utilize an existing hi-lift jack.

A further object of the hitch mounted jack adapter device is to provide for smooth jack I-beam travel within the device.

An added object of the hitch mounted jack adapter device is to provide for safe operation through strength.

And, an object of the hitch mounted jack adapter device is to provide for easy, uncomplicated use.

These together with additional objects, features and advantages of the improved hitch mounted jack adapter device will be readily apparent to those of ordinary skill in the art upon reading the following detailed description of presently preferred, but nonetheless illustrative, embodiments of the improved hitch mounted jack adapter device when taken in conjunction with the accompanying drawings.

DETAILED DESCRIPTION OF THE DRAWINGS

With reference now to the drawings, and in particular FIGS. 1 through 6 thereof, the principles and concepts of the hitch mounted jack adapter device generally designated by the reference number 10 will be described.

Figure 1:
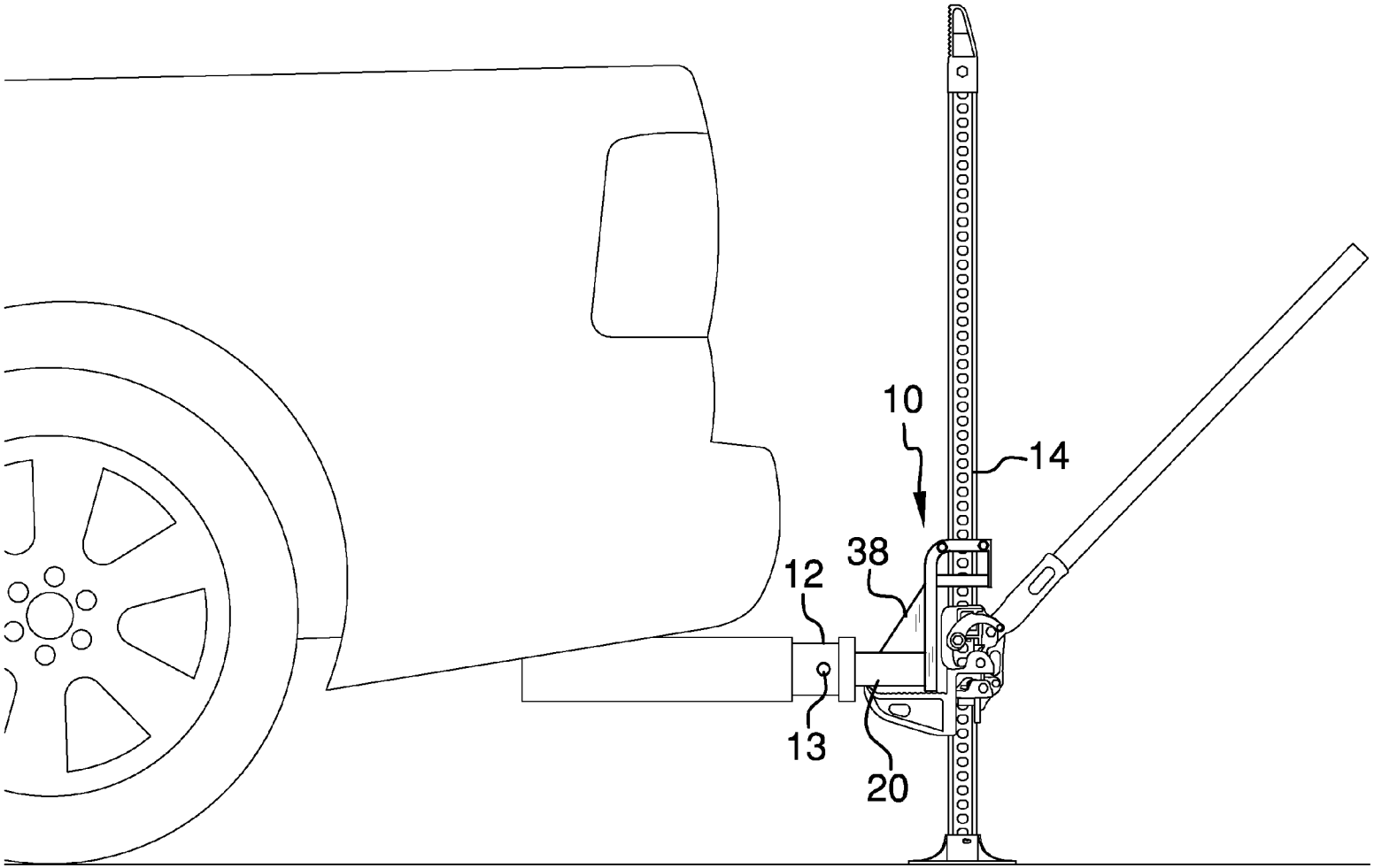
FIG. 1 is a lateral elevation view of the device in use.

Referring to FIG. 1, the device 10 partially comprises the rectangular hitch insert 20 that is slideably received by an existing receiver hitch 12.

Figure 4:
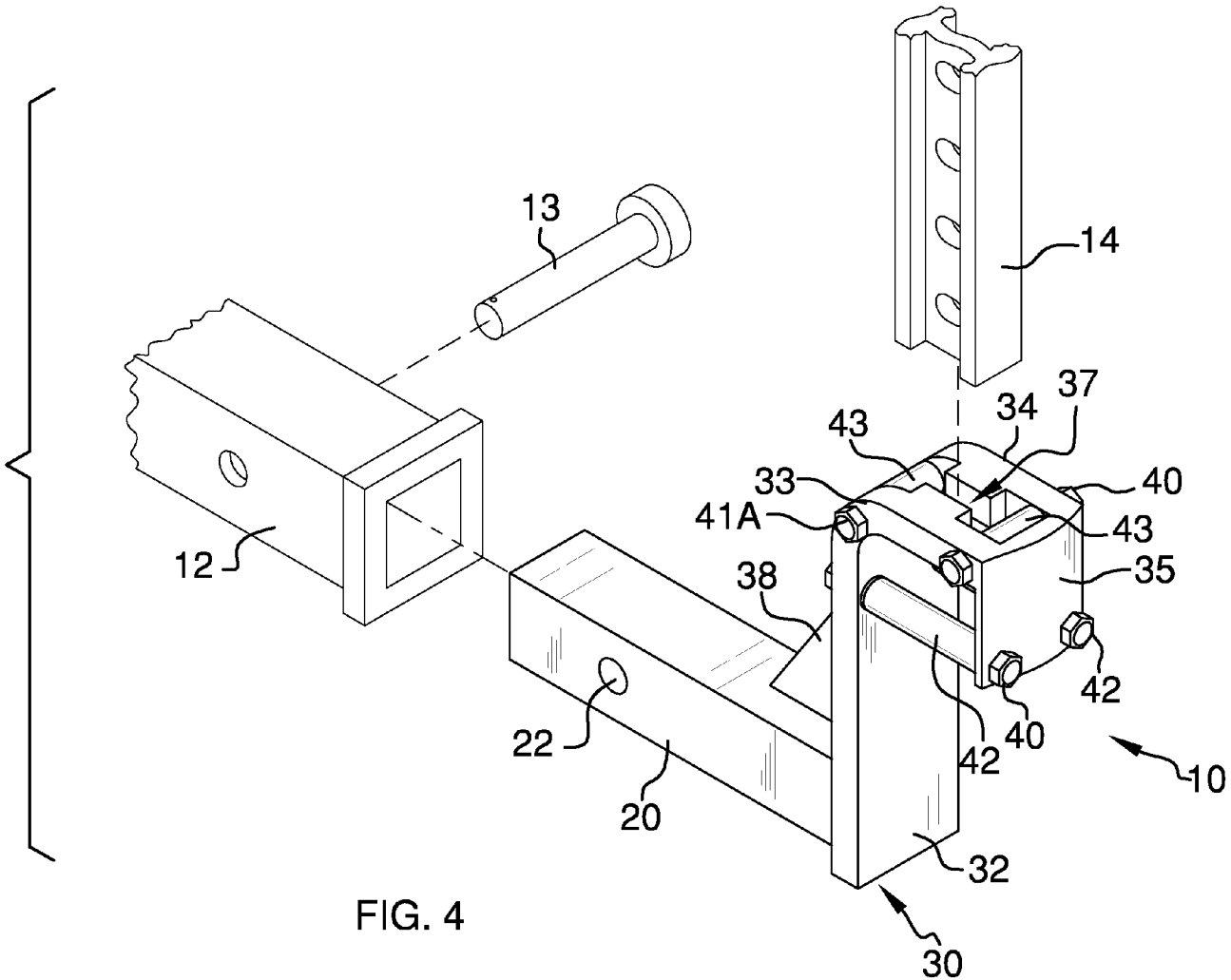
FIG. 4 is a perspective view.
Figure 5:
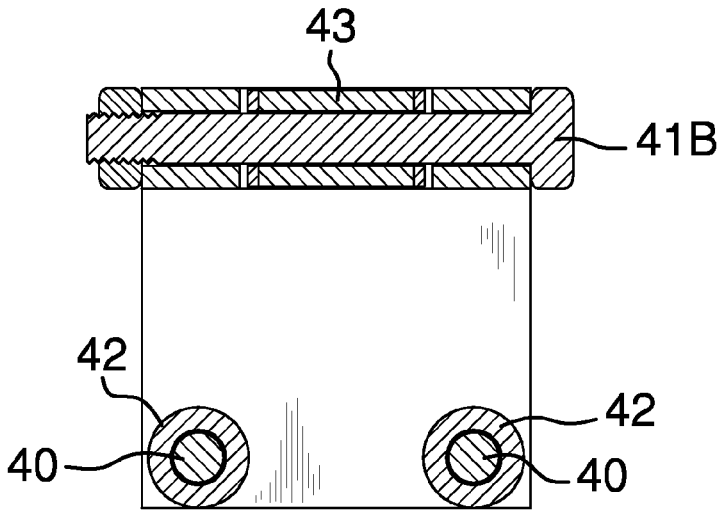
FIG. 5 is a cross sectional view of FIG. 2, taken along the line 5-5.

Referring to FIG. 4, the orifice 22 is disposed horizontally through the hitch insert 20 and is in removable receipt of an existing hitch pin 13 for secure location of the hitch insert 20. The jack receiver 30 is provided and is in removable receipt of an existing hi-lift jack I-beam 14.

Figure 2:
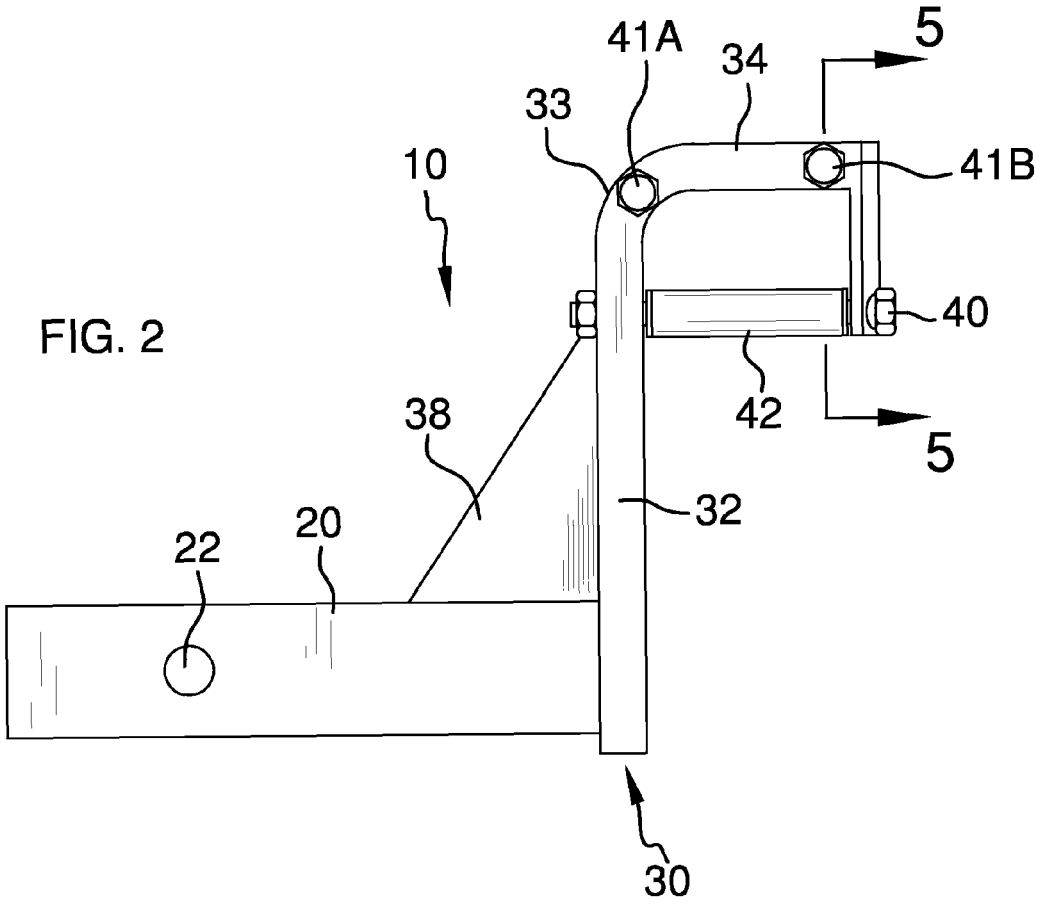
FIG. 2 is a lateral elevation view.

Referring to FIG. 2, the jack receiver 30 partially comprises a riser 32 attached perpendicularly to an end of the hitch insert 20 opposite that received by the receiver hitch 12. The rearwardly disposed 90-degree bend 33 is extended from the riser 32. The horizontal member 34 is extended rearwardly from the bend 33. The back plate 35 is disposed perpendicularly downward from and rearwardly on the horizontal member 34. The back plate 35 has a height 35A positioning the back plate 35 at a level slightly downward from the bend 33.

Figure 3:
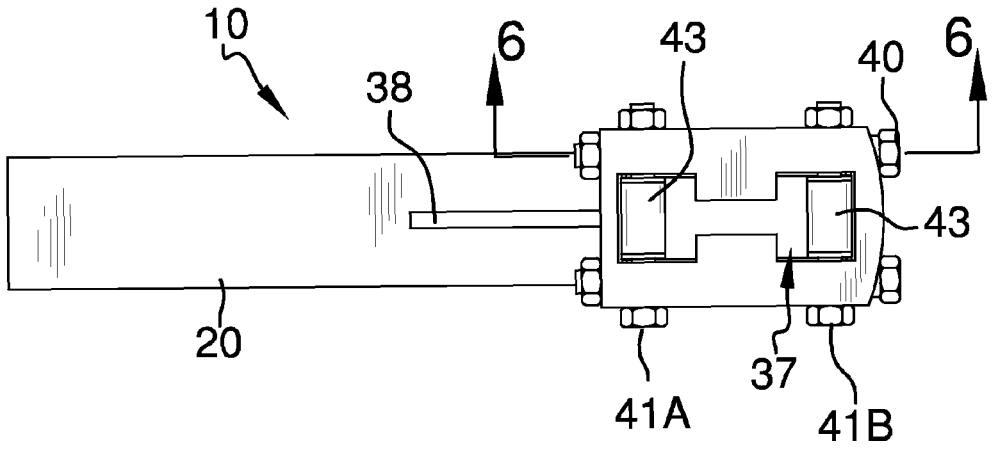
FIG. 3 is a top plan view.

Referring to FIG. 3, the I-shaped jack notch 37 is disposed within the horizontal member 34.

Referring to FIG. 6 and again to FIG. 3, the pair of spaced apart riser bolts with nuts 40 connects the riser 32 with the downward back plate 35 height 35A.

Referring again to FIG. 3, the spaced apart riser bolts with nuts 40 are disposed slightly outward from the I-shaped jack notch 37.

Figure 6:
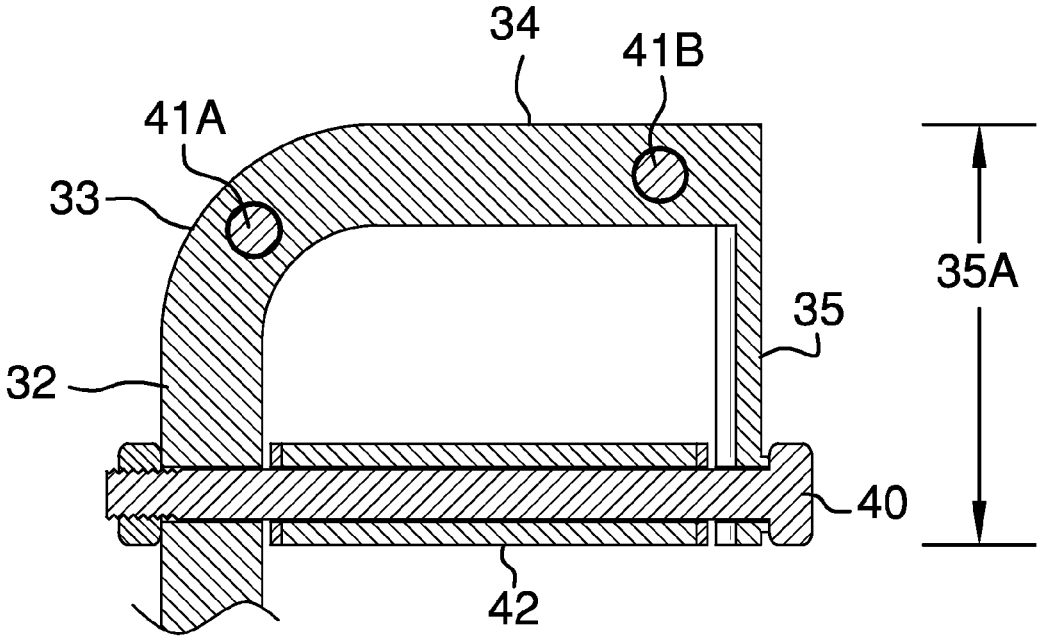
FIG. 6 is a cross sectional view of FIG. 3, taken along the line 6-6.

Referring to FIG. 6, a rotating first roller 42 is disposed on each riser bolt with nut 40. Each first roller 42 is disposed between the riser 32 and the back plate 35.

Referring to FIG. 5 and again to FIG. 3, the pair of jack notch bolts with nuts partially comprises the first jack notch bolt with nut 41A disposed within the bend 33 from a first side of the bend 33 to a second side of the bend 33. The second jack notch bolt with nut 41B is disposed rearwardly through the horizontal member 34, proximal to the back plate 35. A rotating second roller 43 is disposed around each of the pair of jack notch bolts.

Referring again to FIG. 2, the angular gusset 38 is disposed between the hitch insert 20 and the riser 32. The gusset 38 is about upwardly even with the level of the bottom of back plate 35 height 35A.

Referring again to FIG. 1, the I-shaped jack notch 37 and the rollers are slideably and rollably in receipt of the hi-lift jack I-beam 14.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the hitch mounted jack adapter device may be used.

What is claimed is:

1. A hitch mounted jack adapter device comprising, in combination:

a rectangular hitch insert slideably received by an existing receiver hitch;

an orifice disposed horizontally through the hitch insert in removable receipt of an existing hitch pin;

a jack receiver in removable receipt of an existing hi-lift jack I-beam, the jack receiver comprising:

a riser attached perpendicularly to an end of the hitch insert opposite that received by the receiver hitch;

a rearwardly disposed 90-degree bend extended from the riser;

a horizontal member extended rearwardly from the bend;

a back plate disposed perpendicularly downward from and rearwardly on the horizontal member, the back plate having a height positioning the back plate at a level slightly downward from the bend;

a jack notch disposed within the horizontal member;

a pair of spaced apart riser bolts with nuts connecting the riser with the downward back plate height, the spaced apart riser bolts with nuts disposed slightly outward from the jack notch;

a rotating first roller disposed on each riser bolt with nut, each first roller disposed between the riser and the back plate;

a pair of jack notch bolts with nuts comprising a first jack notch bolt with nut disposed within the bend from a first side of the bend to a second side of the bend, a second jack notch bolt with nut disposed rearwardly through the horizontal member, proximal to the back plate;

a rotating second roller disposed around each of the pair of jack notch bolts;

an angular gusset disposed between the hitch insert and the riser, the gusset about upwardly even with the level of a bottom of the back plate height;

whereby the jack notch and the rollers are slideably and rollably in receipt of the hi-lift jack I-beam.

2. A hitch mounted jack adapter device comprising, in combination:

a rectangular hitch insert slideably received by an existing receiver hitch;

an orifice disposed horizontally through the hitch insert in removable receipt of an existing hitch pin;

a jack receiver in removable receipt of an existing hi-lift jack I-beam, the jack receiver comprising:

a riser attached perpendicularly to an end of the hitch insert opposite that received by the receiver hitch;

a rearwardly disposed 90-degree bend extended from the riser;

a horizontal member extended rearwardly from the bend;

a back plate disposed perpendicularly downward from and rearwardly on the horizontal member, the back plate having a height positioning the back plate at a level slightly downward from the bend;

an I-shaped jack notch disposed within the horizontal member;

a pair of spaced apart riser bolts with nuts connecting the riser with the downward back plate height, the spaced apart riser bolts with nuts disposed slightly outward from the I-shaped jack notch;

a rotating first roller disposed on each riser bolt with nut, each first roller disposed between the riser and the back plate;

a pair of jack notch bolts with nuts comprising a first jack notch bolt with nut disposed within the bend from a first side of the bend to a second side of the bend, a second jack notch bolt with nut disposed rearwardly through the horizontal member, proximal to the back plate;

a rotating second roller disposed around each of the pair of jack notch bolts;

an angular gusset disposed between the hitch insert and the riser, the gusset about upwardly even with the level of a bottom of the back plate height;

whereby the I-shaped jack notch and the rollers are slideably and rollably in receipt of the hi-lift jack I-beam.

* * * * *